United States Patent [19]

Takii et al.

[11] Patent Number: 5,036,440

[45] Date of Patent: Jul. 30, 1991

[54] ILLUMINATION TYPE KEYTOP

[75] Inventors: Yasuo Takii; Hitoshi Fujino, both of Furukawa, Japan

[73] Assignee: Alps Electric Co., Ltd., Tokyo, Japan

[21] Appl. No.: 481,485

[22] Filed: Feb. 16, 1990

[30] Foreign Application Priority Data

May 23, 1989 [JP] Japan ..... 1-58661[U]
May 25, 1989 [JP] Japan ..... 1-59688[U]
May 25, 1989 [JP] Japan ..... 1-59689[U]

[51] Int. Cl.[5] ..... F21Q 3/00

[52] U.S. Cl. ..... 362/95; 362/29; 362/293; 362/351

[58] Field of Search ..... 362/29, 30, 293, 95, 362/351, 354, 355

[56] References Cited

U.S. PATENT DOCUMENTS 2,931,117 4/1960 Bosworth et al. ..... 362/351 X
3,076,178 1/1963 Hastings ..... 362/351 X
4,688,156 8/1987 Suzuki et al. ..... 362/29 X
4,758,701 4/1988 Nagel ..... 200/314
4,845,595 7/1989 Fujii et al. ..... 362/30
4,877,308 10/1989 Okuno et al. ..... 362/354 X

FOREIGN PATENT DOCUMENTS 2208560 5/1989 United Kingdom .

*Primary Examiner*—Ira S. Lazarus
*Assistant Examiner*—Y. Quach
*Attorney, Agent, or Firm*—Guy W. Shoup; Paul J. Winters

[57] ABSTRACT

An illumination type keytop is disclosed, in which a transmitted light restricting member is disposed opposite to a display portion formed in a part of a light intercepting layer and a colored and transparent filter member is disposed on the rear side thereof so that the display portion can be illuminated with light having a high directivity, which has passed through the transmitted light restricting member, at the illumination in the night, etc.

4 Claims, 2 Drawing Sheets

ILLUMINATION TYPE KEYTOP

FIELD OF THE INVENTION

The present invention relates to an illumination type keytop mounted on a switch used in a vehicle, etc., whose display portion is illuminated in the night, etc.

BACKGROUND OF THE INVENTION

FIG. 5 shows a prior art example of this kind of keytops.

In the figure, reference numeral 1 represents a keytop as a whole. A display portion 2 having a predetermined shape, which faces on the top surface of the keytop 1, can be illuminated. This keytop 1 consists of base material 3 made of a transparent synthetic resin such as acrylic resin, etc., a base layer 4 made of colored paint such as white paint, etc., which is also transparent, applied on the surface of the base material 3, and a light intercepting layer 5 made of opaque paint such as black paint, etc., applied on the surface of the base layer 4. The display portion stated above is formed by removing a part of the light intercepting layer 5 having a predetermined shape by laser trimming so as to expose the base layer 4. In the light in the daytime, etc. the display portion 2 can be recognized by the eye, because the difference in the color between the base layer 4 and the light intercepting layer 5 is clarified by external light and on the other hand in the dark in the night or in a tunnel, etc. the display portion 2 illuminated in the dark can be recognized by lighting a lamp 6 disposed within the keytop 1 and by utilizing the fact that light emitted by it passes through the base material 3 and the base layer 4 and on the contrary it is not transmitted by the light intercepting layer 5.

Further a transparent hard coat layer may be applied over the whole external surface of the keytop 1 at need.

However, in the prior art keytop constructed as described above, since the directivity of the light emitted from the display portion 2 to the exterior is not so high, when it is illuminated in the night etc., a part of the light emitted from the display portion 2 is reflected towards the front glass, etc. Therefore so-called window reflection was apt to be produced. Consequently, in order to cut-off the light directed in undesired directions, measures have been taken by disposing the keytop 1 in a sequestered position such as in a recess. However, by this method, the restriction on the design of various members in the neighborhood of the keytop 1 is great, and therefore it cannot be said to be a desirable solution.

OBJECT OF THE INVENTION

Therefore the object of the present invention is to provide an illumination type keytop capable of solving the problems of the prior art techniques described above by preventing the window reflection, which does not restrict the design of the neighborhood.

SUMMARY OF THE INVENTION

In order to achieve the above object, an illumination type keytop according to the present invention, in which a display portion having a predetermined shape, which is transparent, is disposed in a part of light intercepting layer so as to face on the top surface side and the display portion stated above is illuminated with light coming from the rear side, is characterized in that it comprises further a transmitted light restricting member disposed on the rear side of the light intercepting layer, at least opposite to the display portion described above, which has an optical anisotropy and makes light pass through, depending on the incident angle, and a colored and transparent filter member disposed on the rear side of the transmitted light restricting member.

If the keytop is constructed as described above, when illuminated in the night, etc., since the display portion can be illuminated with light having a high directivity, which has passed through the transmitted light restricting member, it is possible for the light issued by the display portion not to be directed in undesired directions.

DETAILED DESCRIPTION

Figure 1:
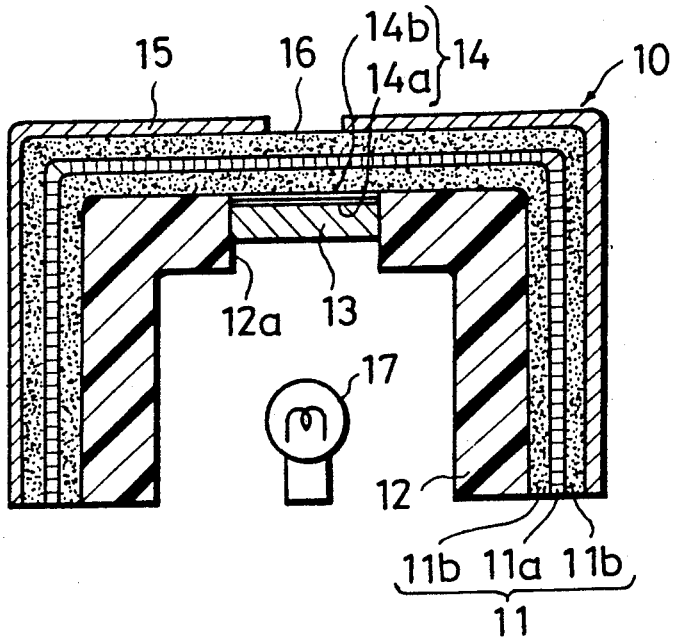
FIG. 1 is a cross-sectional view of a keytop, which is an embodiment of the present invention.

Hereinbelow some preferred embodiment of the present invention will be explained, referring to the drawings.

Figure 2:
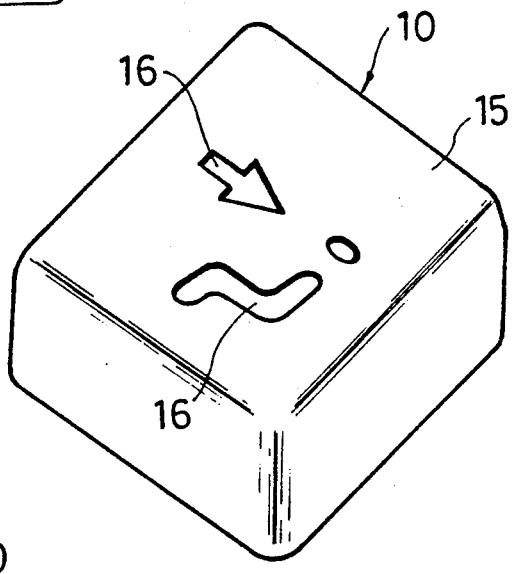
FIG. 2 is a perspective view of the keytop indicated in FIG. 1.

FIG. 1 is a cross-sectional view of a keytop, which is an embodiment of the present invention, and FIG. 2 is a perspective view of this keytop, in which reference numeral 10 represents the keytop as a whole.

The keytop 10 indicated in these figures consists of a transmitted light restricting member 11 called light control film or view control film formed in a knob shape by dishing; a reinforcing member 12, which is a mold made of ABS resin, etc., having a through hole **12*a* at the central portion and reinforcing the transmitted light restricting member 11 on the rear side; a colored filter layer 14, in which transparent colored paint 14*a* and white paint 14*b* applied on the surface of a transparent film 13 mounted within the through hole 12*a* formed in this reinforcing member 12; and a light intercepting layer 15 made of black opaque paint and deposited on the surface of the transmitted light restricting member 11. The display portion 16 having a predetermined shape is formed so as to face on the top surface of the keytop 10 by exposing the transmitted light restricting member 11 and the colored filter layer 14 by removing a part of the light intercepting layer 15** by laser trimming.

Further there is disposed an illuminating lamp 17 within this keytop 10. In addition, a transparent hard coating layer may be disposed over the whole outer surface of the keytop 10 at need.

The keytop 10 constructed as described above is fabricated substantially as follows.

At first a plate-shaped transmitted light restricting member 11 having a laminate structure is worked so as to be in a knob shape by dishing. This transmitted light restricting member 11 has a well known construction, which consists of a transmission restricting portion **11*a* formed by superposing transparent resin such as silicone gum, etc. and band-shaped black resin alternately and parallelly many times with a predetermined pitch and a transparent film and includes further a pair of supporting plates 11*b* putting the transmission restricting portion 11***a* therebetween through transparent adhesive, having a property of making light pass through selectively, depending on the incident angle. Then a reinforcing member 12 backing the transmitted light restricting member 11 is formed by inserting this knob-shaped transmitted light restricting member 11 in a mold to form synthetic resin material. Therefore the light intercepting layer 15 and the display portion 16 are formed by depositing light intercepting black paint on the surface of the transmitted light restricting member 11 by application, sputtering, evaporation, etc. and removing a part thereof by the laser etching technique. Then, before or after this fabrication step, transparent colored paint 14*a* having the light transmitting property and white paint 14*b* are printed on the surface of a transparent film 13 made of polycarbonate, etc. to form a colored filter layer 14 and the transparent film 13 including this colored filter layer 14 is mounted within the through hole 12*a* formed in the reinforcing member 12 and fixed there.

In the keytop 10 as described above, since the difference in the color between the white paint 14*b* in the colored filter layer 14 and the light intercepting black layer 15 exposed in the display portion 16 through the transmitted light restricting member 11 is clarified by external light in the light in the daytime, etc., the display portion 16 can be recognized by the eye. Further, in the night or in the dark in a tunnel, etc., the display portion 16 bordered with the light intercepting layer 15, which the light emitted by the lamp 17 cannot pass through, is recognized by the eye. At this time, since the directivity of the light transmitted through the transmitted light restricting member 11 is significantly increased, even if the design of members in the neighborhood of the keytop 10 is not modified, it is possible for the light emitted by the display portion 16 not to be directed in undesired directions such as towards the front glass, etc. and therefore window reflection is not feared.

Figure 3:
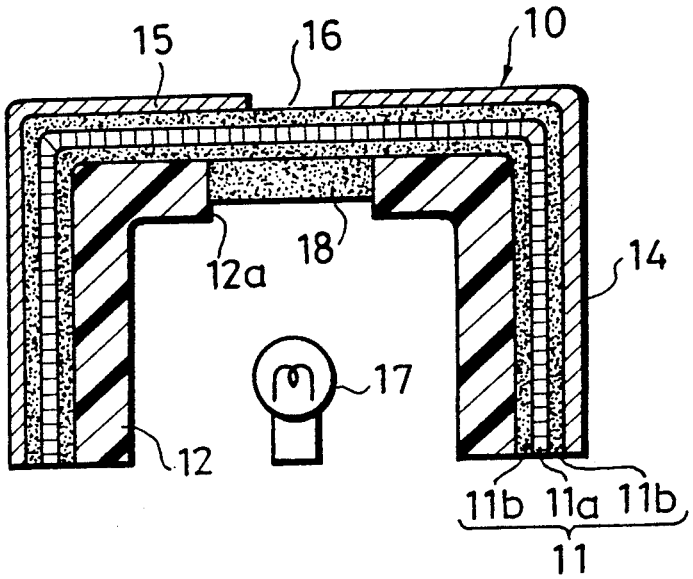
FIG. 3 is a cross-sectional view of a keytop, which is a second embodiment of the present invention.

FIG. 3 shows the second embodiment of the present invention, where the items corresponding to those indicated in FIGS. 1 and 2 are denoted by the same reference numerals. In the figure, the keytop 10 is constructed by adhering a colored film 18, on the surface of which transparent white paint is applied, instead of the transparent film 13 used in the preceding embodiment, to the rear surface of the transmitted light restricting member 11 e.g. through transparent adhesive, so as to be fixed to the through hole formed in the reinforcing member 12. Consequently it is not necessary to prepare separately members for printing the colored filter layer. Therefore, since the number of parts is decreased with respect to that described in the present embodiment, and at the same time the white paint 14*b* of the colored filter layer 14 is positioned just behind of the display portion 16, the recognizability of the display portion 16 by the eye when the lamp is not lighten is improved.

Figure 4:
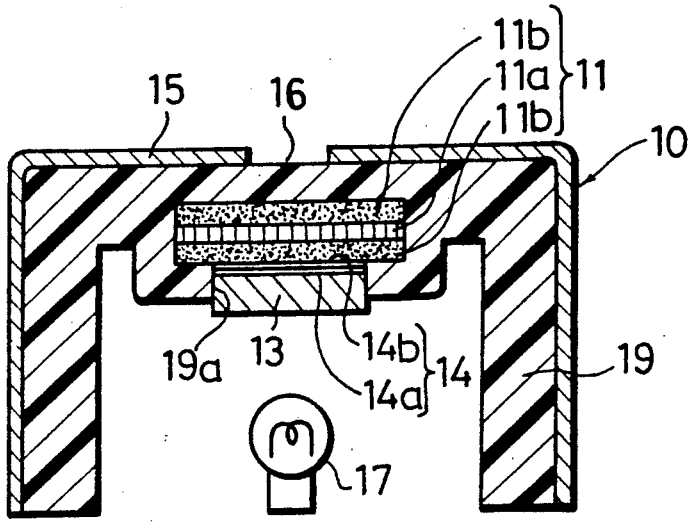
FIG. 4 is a cross-sectional view of a keytop, which is a third embodiment of the present invention.
Figure 5:
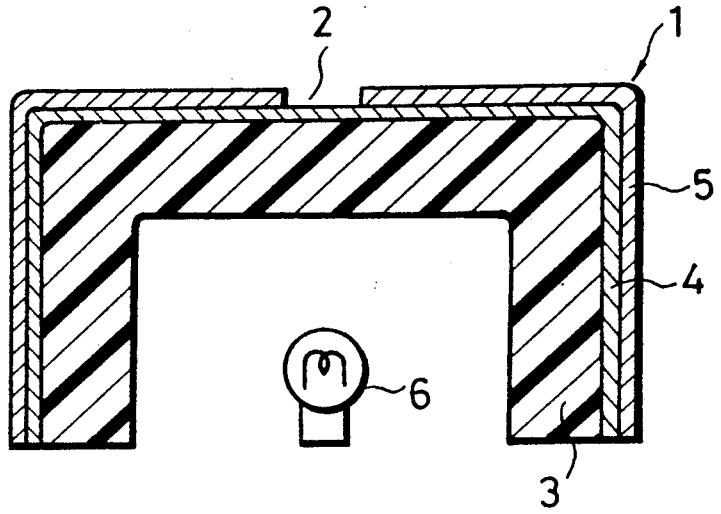
Fig. 5 PRIOR ART
FIG. 5 is a cross-sectional view of a prior art keytop.

FIG. 4 is a cross-sectional view of a keytop, which is the third embodiment of the present invention, where the items corresponding to those indicated in FIGS. 1 and 2 are denoted by the same reference numerals.

The keytop 10 indicated in FIG. 4 is fabricated as follows. At first, the transmitted light restricting member 11 having a magnitude corresponding to the display portion is inserted in a mold to form transparent resin and thus a knob-shaped base material 19, in which the transmitted light restricting member 11 is buried, is obtained. Thereafter, the transparent film 13 having the colored filter layer 14 is mounted within a lower hole 19*a* formed in the base material 19 and fixed there.

For the keytop 10 constructed as described above, the recognizability by the eye is improved just as in the preceding embodiments, even if the transmitted light restricting member 11 is not used over the whole surface of the knob.

As explained above, in the illumination type keytop according to the present invention, when illuminated in the night, etc., since the display portion is illuminated with light having a high directivity, which has passed through the transmitted light restricting member, it is possible for the light issued by the display portion not to be directed in undesired directions and in this way an excellent effect can be obtained that window reflection is prevented without restricting the design of the members in the neighborhood thereof.

What is claimed is:

1. An illumination type keytop, in which a display portion having a predetermined shape, which is transparent, is disposed in a part of a light intercepting layer so as to face on the top surface side and said display portion is illuminated with light coming from the rear side, comprising:

a transmitted light restricting member disposed on the rear side of said light intercepting layer, at least opposite to said display portion, which has an optical anisotropy and makes light pass through, depending on the incident angle; and a colored and transparent filter member disposed on the rear side of said transmitted light restricting member.

2. An illumination type keytop according to claim 1 wherein said transmitted light restricting member is worked so as to have a knob-shape by dishing, said light intercepting layer being disposed on the surface of said transmitted light restricting member; said filter member is disposed on the rear side of said transmitted light restricting member at least at a place opposite to said display portion, which member is secured to a reinforcing member made of a transparent resin mold backing said transmitted light restricting member.

3. An illumination type keytop according to claim 1 wherein said transmitted light restricting member is buried in a base material formed by shaping said transparent resin at a place opposite to said display portion, said light intercepting layer being disposed on the surface of said base material, and said colored filter is disposed on the rear side of said transmitted light restricting member.

4. An illumination-type keytop comprising:

a reinforcing member defining a through-hole;

a colored filtered layer disposed adjacent said through-hole;

a transmitted light restricting member substantially covering said through-hole and said colored filter layer, said transmitted light restricting member comprising a transmission restricting layer through which light from a preselected incident angle is passed; and a light intercepting layer disposed over said transmitted light restricting member, said light restricting layer defining a display portion disposed opposite a portion of said through-hole

* * * * *